US009574368B2

(12) United States Patent
Kayser

(10) Patent No.: US 9,574,368 B2
(45) **Date of Patent: *Feb. 21, 2017**

(54) REMOVABLY MOUNTABLE ROOF FRAME FOR USE WITH AN EXPANDABLE CANOPY

(71) Applicant: KD KANOPY, INC., Westminster, CO (US)

(72) Inventor: Matt Kayser, Highlands Ranch, CO (US)

(73) Assignee: KD KANOPY, INC., Westminster, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/657,967

(22) Filed: Mar. 13, 2015

(65) Prior Publication Data

US 2016/0047139 A1 Feb. 18, 2016

Related U.S. Application Data

(63) Continuation of application No. 13/887,011, filed on May 3, 2013, now Pat. No. 8,978,680.

(Continued)

(51) Int. Cl.

*E04H 15/50* (2006.01)
*E04H 15/44* (2006.01)

(Continued)

(52) U.S. Cl.

CPC ..... *E04H 15/50* (2013.01); *E04H 15/34* (2013.01); *E04H 15/36* (2013.01); *E04H 15/44* (2013.01); *E04H 15/46* (2013.01); *Y10T 403/342* (2015.01)

(58) Field of Classification Search

CPC ..... E04H 15/34; E04H 15/36; E04H 15/46; E04H 15/48; E04H 15/50; E04H 15/44; Y10T 403/342; Y10T 403/34

(Continued)

(56) References Cited

U.S. PATENT DOCUMENTS 1,204,329 A * 11/1916 Wilkins ..... E04H 15/44 135/151
5,115,828 A 5/1992 Spaulding (Continued)

FOREIGN PATENT DOCUMENTS

FR 2849668 A1 7/2004
JP 2011144606 A 7/2011
WO 9827296 A1 6/1998

*Primary Examiner* — Winnie Yip
(74) *Attorney, Agent, or Firm* — Perkins Coie LLP

(57) ABSTRACT

An erectable canopy framework comprising a base frame and a roof frame. The roof frame is operative to support a canopy above the base frame and is removably mountable to the base frame. The base frame includes a plurality of upright support members, a plurality of cross members, each interconnecting adjacent upright support members, and a plurality of mounts disposed on the upright support members. Each mount includes a mount opening and each cross member includes a scissor assembly to permit movement of the base frame between expanded and a collapsed states. The mounts are operative to fasten the cross members to the upright support members. The roof frame includes a plurality of rafters each connectable to a corresponding mount opening. The framework comprises a plurality of rafter fittings each adapted for insertion into a corresponding mount opening and connectable to a corresponding rafter.

13 Claims, 15 Drawing Sheets

Related U.S. Application Data

(60) Provisional application No. 61/642,767, filed on May 4, 2012.

(51) Int. Cl.
*E04H 15/34* (2006.01)
*E04H 15/36* (2006.01)
*E04H 15/46* (2006.01)

(58) Field of Classification Search
USPC ..... 135/120.3, 122, 124, 131, 135–136,135/145–147, 151, 158–159, 906; 403/170–171
See application file for complete search history.

(56) References Cited

U.S. PATENT DOCUMENTS 5,244,001 A 9/1993 Lynch
5,511,572 A 4/1996 Carter
5,632,293 A 5/1997 Carter
5,709,238 A 1/1998 Mattioli
5,797,412 A 8/1998 Carter
D409,762 S 5/1999 Blessing
5,921,260 A 7/1999 Carter
6,000,175 A 12/1999 Gale et al.
6,076,312 A 6/2000 Carter
6,089,247 A * 7/2000 Price ..... E04H 15/48 135/145
6,148,835 A * 11/2000 Rhee ..... E04H 15/50 135/128
6,240,940 B1 6/2001 Carter
6,283,136 B1 * 9/2001 Chen ..... E04H 15/48 135/130
6,382,224 B1 * 5/2002 Carter ..... E04H 15/50 135/114
6,412,507 B1 7/2002 Carter
6,431,193 B2 8/2002 Carter
6,439,251 B2 8/2002 Carter
6,470,902 B1 10/2002 Carter
6,601,599 B2 8/2003 Carter
6,742,309 B2 6/2004 Stewart et al.
6,748,963 B2 6/2004 Carter
6,874,520 B2 4/2005 Carter
6,920,889 B2 7/2005 Carter
7,051,745 B2 5/2006 Carter
7,146,995 B2 12/2006 Lapping
7,178,541 B2 2/2007 Carter
7,219,681 B1 * 5/2007 Hamilton-Jones .... E04H 15/322 135/119
7,252,108 B2 8/2007 Carter
7,275,555 B2 10/2007 Powell et al.
7,290,553 B2 11/2007 Prevost
7,363,933 B2 4/2008 Carter
7,530,364 B2 5/2009 Carter
7,584,763 B2 * 9/2009 Yoon ..... E04H 15/52 135/131
7,628,166 B2 * 12/2009 Carter ..... E04H 15/50 135/124
7,640,943 B2 1/2010 Carter
7,735,505 B2 6/2010 Carter
7,836,907 B2 11/2010 Carter
7,891,369 B2 2/2011 Carter
8,056,573 B2 11/2011 Panigot
8,215,326 B2 7/2012 Park et al.
8,220,476 B2 7/2012 VanElverdinghe et al.
8,544,489 B2 10/2013 Choi et al.
2004/0084074 A1 5/2004 Chiu et al.
2006/0185708 A1 8/2006 Sylvestre et al.
2008/0066795 A1 3/2008 Sy-Facunda et al.
2009/0314323 A1 * 12/2009 Park ..... E04H 15/44 135/145
2010/0275962 A1 * 11/2010 Park ..... E04H 15/50 135/122
2011/0041886 A1 2/2011 Carter
2011/0061702 A1 * 3/2011 Lin ..... E04H 15/50 135/145

* cited by examiner

REMOVABLY MOUNTABLE ROOF FRAME FOR USE WITH AN EXPANDABLE CANOPY

BACKGROUND

Collapsible canopies are well-known in the art of portable shelters. Collapsible canopies may be expanded to support a flexible canopy covering to protect people front the elements, such as rain and sunshine. These canopies may also be collapsed into a compact state such that they are more easily transported. Typically, the framework includes upright support members, or legs, interconnected by a plurality of expandable and collapsible scissor assemblies. The framework often includes central support provided for supporting the canopy covering in a peaked configuration in order to shed water.

As collapsible canopies have gained in popularity for use at sporting events, trade shows, flea markets, concerts, and the like, advertisers have recognized the opportunity to exploit the surface area of the canopy's roof for advertising. However, the peaked configuration of traditional collapsible canopies is not always conducive to display large logos, slogans, pictures, etc. The peaked dome typically only provides a small vertical margin area on each side of the canopy for displaying advertising material. The sloped portions of the peaked configuration are typically not easily visible from the ground.

There are some collapsible canopies that have different roof configurations, such as a gabled configuration. However, typically these other roof configurations are part of the expandable mechanism in the canopy's framework. Thus, the roof configuration is fixed. Moreover, the framework complexity is increased by the expandable roof portion and is therefore more susceptible to damage and is more expensive to produce. Having integrated roof that is permanently attached also increases the weight of the canopy framework. Furthermore, in order to have multiple roof configurations available for various circumstances, a user must purchase and maintain several complete canopy frames.

Accordingly, there is a need for a collapsible canopy with a versatile roof frame that is capable of being changed between different roof configurations in order to suit a user's needs.

SUMMARY

Provided herein is an erectable canopy framework comprising a base frame and a roof frame. The base frame includes a plurality of upright support members, a plurality of cross members, each interconnecting adjacent upright support members, and a plurality of mounts disposed on the upright support members. Each cross member may include a scissor assembly or, more generally, an expansion and contraction assembly to permit movement of the base frame between an expanded and a contracted state. The mounts are operative to fasten the cross members to the upright support members. In an embodiment, each mount includes a mount opening. The roof frame is operative to support a canopy above the base frame and is removably mountable to the base frame. The roof frame includes a plurality of rafters each connectable to a corresponding mount opening.

In an embodiment, each rafter includes a stub portion and an arm portion extending at an angle therefrom. The stub portion is adapted for insertion into a corresponding mount opening. In one instance, the arm portion extends from the stub portion at approximately a 45 degree angle. Each rafter may be comprised of a piece of bent tubing. A ridge member extends between distal ends of the rafter portions. A pair of ridge fittings interconnects a pair of rafters with opposite ends of the ridge member. The rafters and ridge member may each comprise multiple rafter or ridge segments, respectively.

In another embodiment, the framework comprises a plurality of rafter fittings each adapted for insertion into a corresponding mount opening and connectable to a corresponding rafter. Each rafter listing comprises a male portion insertable into the corresponding mount opening and a socket, which may be in the form of a ferrule, pivotably attached to the male portion. Each socket is adapted to receive a corresponding rafter and each rafter extends arcuately from the corresponding socket. In one aspect of the technology, each rafter comprises at least one flexible rod. In yet another embodiment, each rafter extends diagonally between opposite upright support members. In another aspect of the technology, the framework may be fitted with a canopy that is extendable over the roof frame forming an expandable canopy. In yet another aspect of the technology described herein, the framework comprises a plurality of mounts, each including a socket pivotably attached thereto such that each rafter is received in a corresponding socket.

In another embodiment, a pair of cross member rafters extend arcuately between opposed scissor assemblies. Each scissor assembly includes a pair of scissor units connected together by upper and lower cross member mounts. The upper cross member mount includes an insert opening adapted to receive a cross member rafter insert that is connectable with a corresponding cross member rafter.

Also disclosed herein is a rafter fitting for use with an erectable canopy framework that includes a base frame and a roof frame removably mountable to the base frame. The base frame includes a plurality of upright support members and a plurality of mounts disposed on the upright support members, wherein each mount includes a mount opening, and wherein the roof frame includes a plurality of rafters. The rafter fitting includes a male portion insertable into a corresponding mount opening and a socket pivotably attached to the male portion. The socket is configured to receive a portion of a corresponding rafter.

In one aspect of the technology, the socket pivots about a pivot axis that is oriented such that the corresponding rafter received therein extends diagonally between opposite upright support members. In an embodiment, the male portion has a rectangular cross-section and the socket pivots about a pivot axis oriented at approximately a 45 degree angle with respect to the rectangular cross-section. A clevis bracket is disposed on the male portion and a clevis pin extends through the ferrule to define the pivot axis.

Also contemplated herein is a method of erecting a canopy. The method comprises expanding a base frame that includes a plurality of upright support members and a plurality of mounts disposed on the upright support members, mounting a roof frame to the base frame, and subsequently removing the roof frame from the base frame. The step of mounting the roof frame to the base frame includes connecting rafter fittings to the mounts. The mounts include mount openings and the rafter fittings are inserted into the mount openings. The method may also include connecting rafters to the rafter fittings and connecting a ridge member to the rafters.

These and other aspects of the technology and its various embodiments will be apparent after consideration of the Detailed Description and Figures herein. It is to be understood, however, that the scope of the invention shall be determined by the claims as issued and not by whether given subject matter addresses any or all issues noted in the background or includes any features or aspects recited in this summary.

DRAWINGS

Non-limiting and non-exhaustive exemplary embodiments of the removably mountable roof frame, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
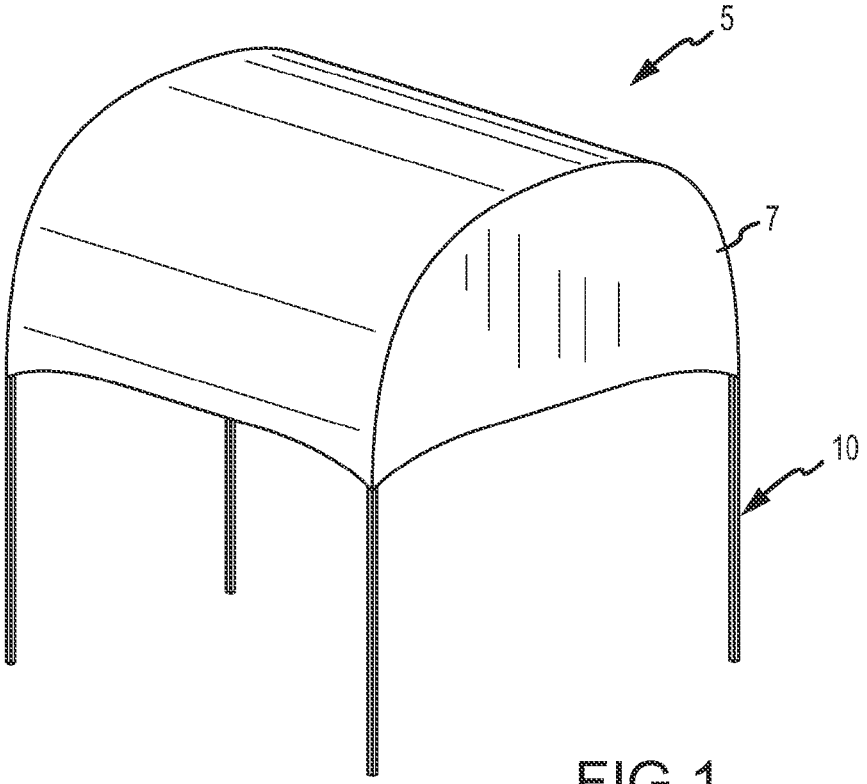
FIG. 1 is a perspective view of a canopy having a rounded gable roof.
Figure 2:
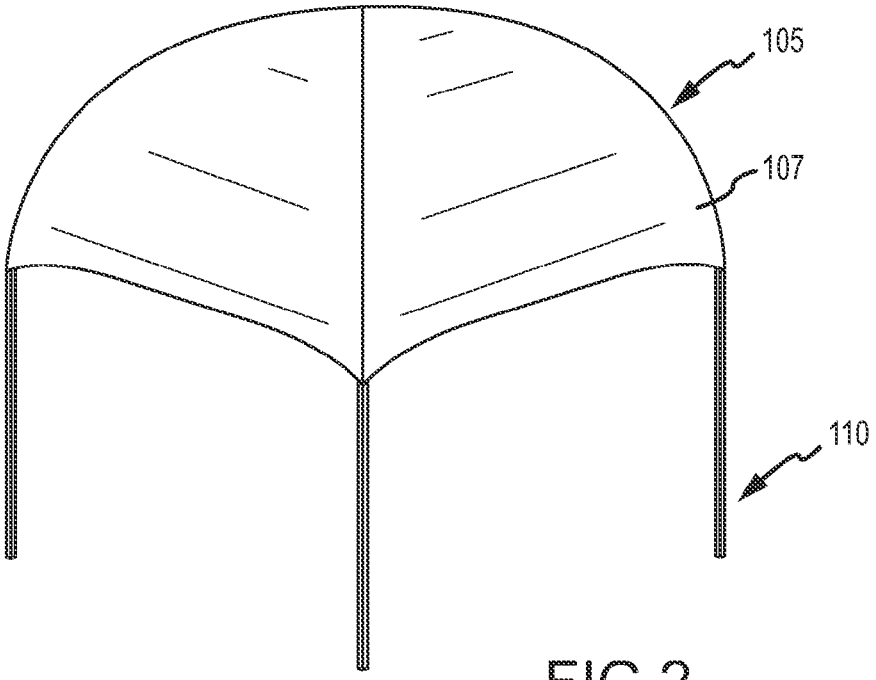
FIG. 2 is a perspective view of a canopy with a domed roof.

Described herein are various embodiments of a removably mountable roof frame for use with an expandable canopy, which allows the roof configuration of the canopy to be changed between different configurations in order to suit a user's needs. FIG. 1 shows a canopy 5 according to a first exemplary embodiment that has a rounded gable roof, or otherwise referred to as a barrel-shaped roof. The canopy includes a framework 10 which supports a canopy cover 7. Canopy cover 7 is configured to conform to an underlying framework structure 10 that defines the rounded gable shape. FIG. 2 illustrates a canopy 105 according to a second exemplary embodiment that is the form of a dome. Canopy 105 includes a framework 110 and a canopy cover 107.

Figure 3:
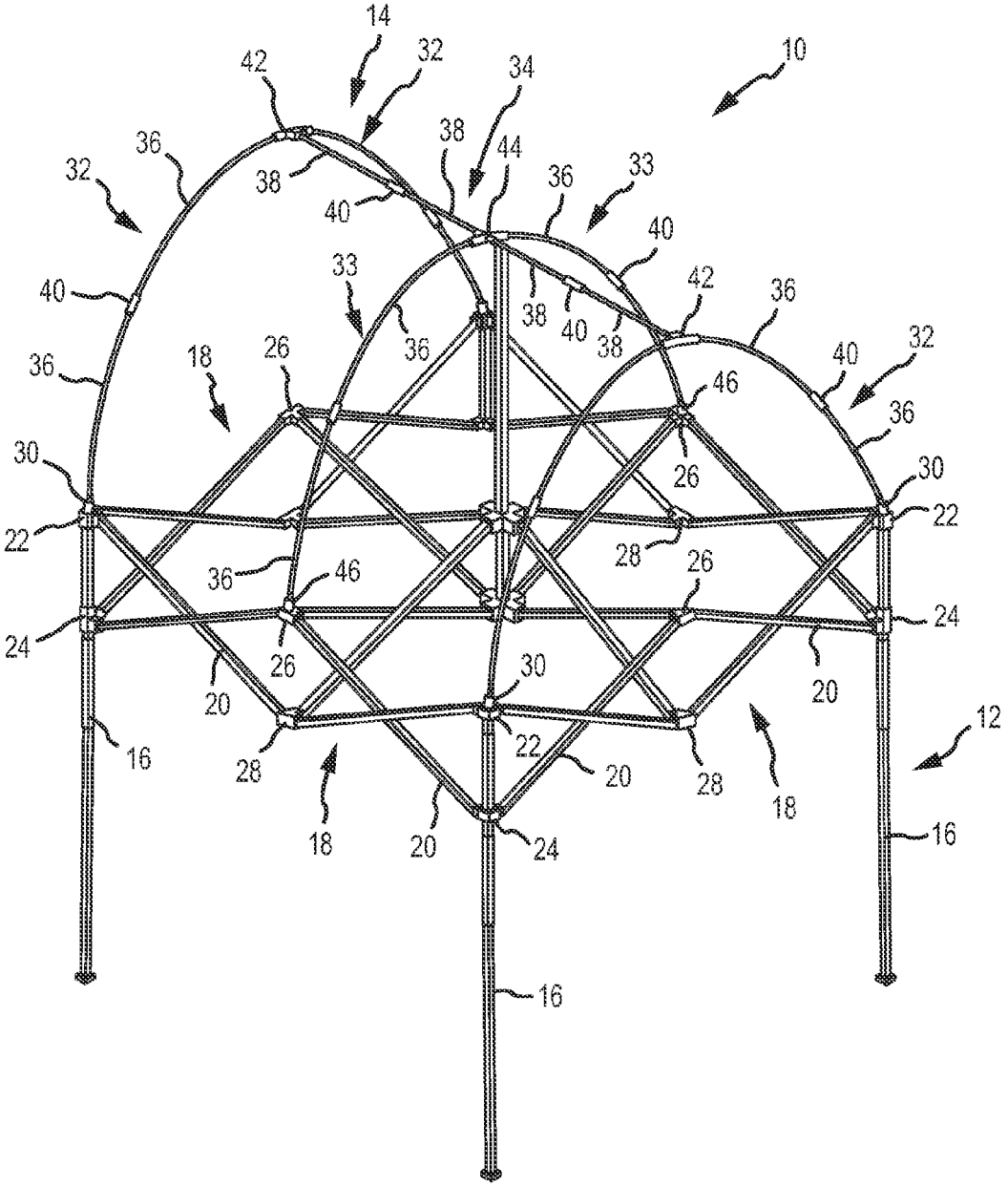
FIG. 3 is a perspective view of the framework for the canopy shown in FIG. 1.

With reference to FIG. 3, the underlying framework 10 of canopy 5 can be better appreciated. Framework 10 includes a base frame 12 and a roof frame 14 which is removably mountable to the base frame 12. As is known in the art, base frame 12 includes a plurality of upright support members 16 which are interconnected by a plurality of cross members 18. Cross members 18 may comprise an expansion and contraction assembly which, in the referenced embodiment are shown in the form of a pair of scissor units 20, though the artisan will appreciate that the term should not be limited as such and is intended to encompass any cross member construct that can be moved between expanded and contracted states, such as telescopic, folding, bending, etc, whether known or unknown in the art. The scissor units 20 are connected to the upright support members 16 by a fixed mount 22 and a sliding mount 24. Accordingly, the cross members allow the base frame to expand and collapse. Each pair of scissor units 20 that are connected to each other by upper and lower cross member mounts 26 and 28, respectively. Base frame 12 is constructed similar to the collapsible canopy framework described in U.S. Pat. No. 5,244,001 issued to Lynch, the disclosure of which is incorporated herein by reference in its entirety.

Figure 4:
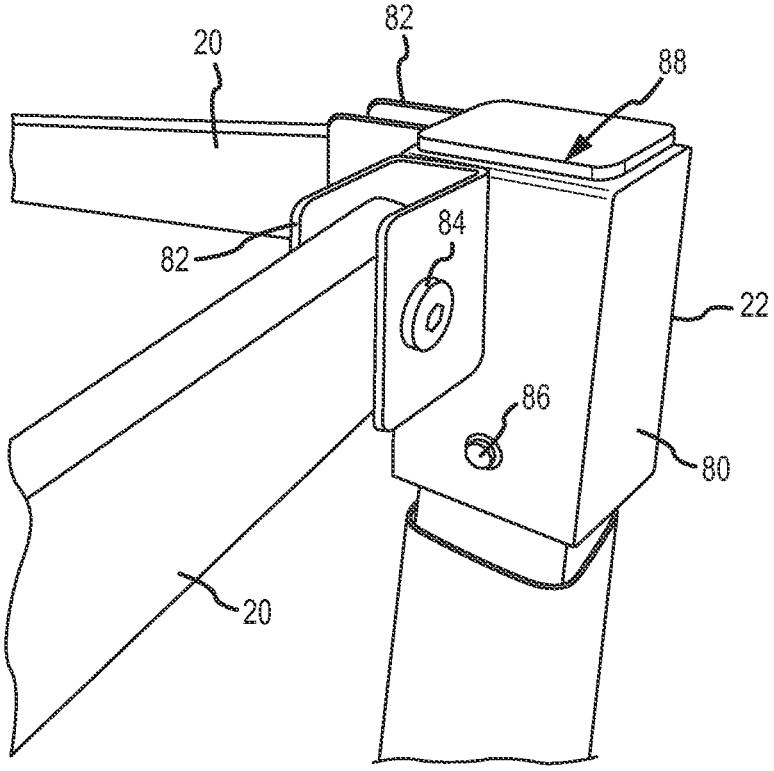
FIG. 4 is an enlarged close-up view of a mount as shown in FIG. 3.

Roof frame 14 includes a plurality of rafters 32, each of which is connectable to a corresponding mount 22 on base frame 12. Rafters 32 are operative to support the canopy cover 7 above the base frame 12. With reference to FIG. 4, mount 22 includes central portion 80 with a mount opening 88. Attached to the central portion 80 is a pair of clevis portions 82. Clevis portions 82 are configured to receive the scissor units 20 therein. A fastener 84 secures the scissor units to the clevis portions 82. In this case mount 22 is fabricated from tubing and sheet metal that has been formed into a clevis portion. These components may be welded or fastened together. Furthermore, the mount may be formed as a unitary body, which may be achieved through an injection molding process, all as known in the art.

Figure 5:
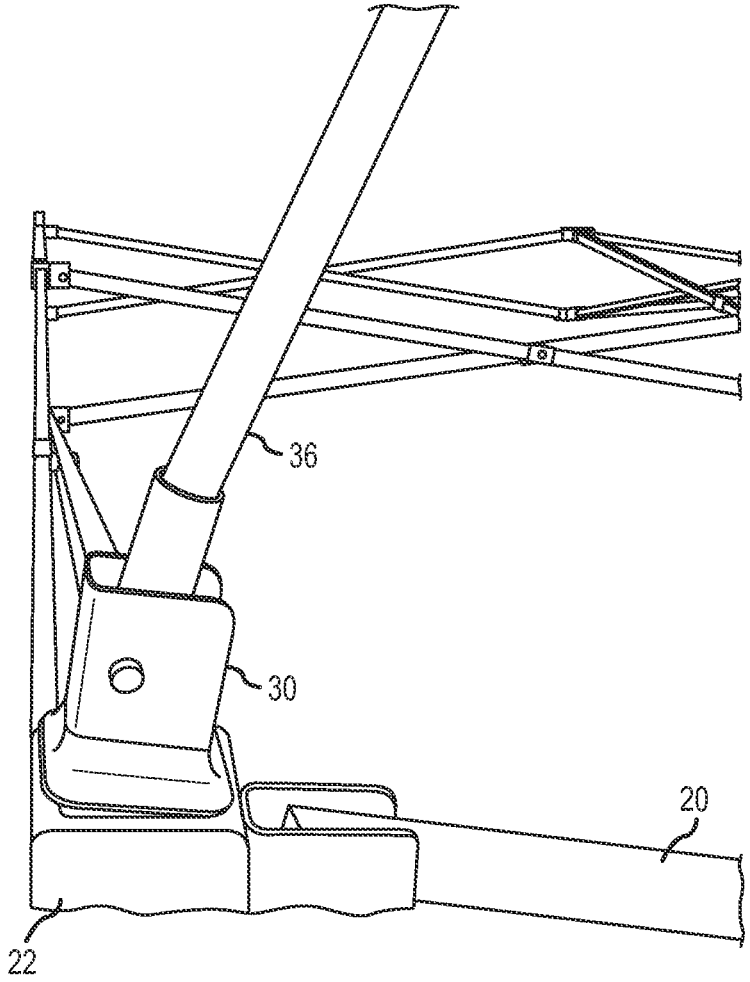
FIG. 5 is an enlarged perspective view of the rafter fitting as shown in FIG. 3.
Figure 6A:
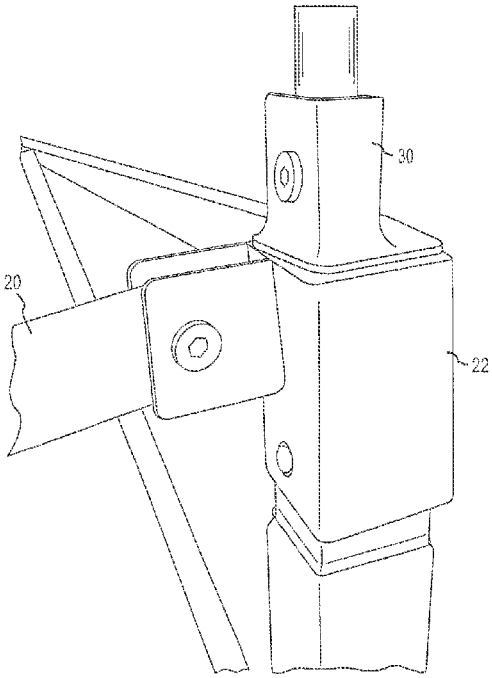
FIG. 6A is an enlarged perspective view of the rafter fitting as shown in FIG. 3.
Figure 7:
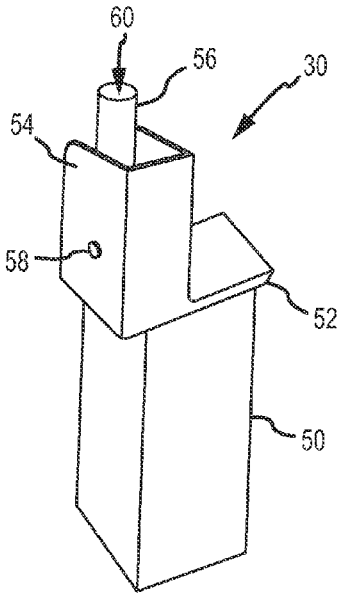
FIG. 7 is a perspective view of the rafter fitting shown in FIG. 3.

With reference to FIGS. 5, 6A, and 7, the roof framework includes a plurality of rafter fittings 30, each of which is adapted for insertion into a corresponding mount opening 88 and is connectable to a corresponding rafter 32. With particular reference to FIG. 7, rafter fitting 30 includes a male portion 50 which is insertable into the mount opening 88. Cap 52, which is disposed on the top of mount portion 50, provides an end stop for the fitting. A clevis bracket 54 is attached to cap 52 and rotatably supports a socket 56. Socket 56 is retained in clevis 54 by a clevis pin 58. In this case, clevis pin 58 is in the form of a threaded fastener as known in the art. In this case, socket 56 is in the fun of a ferrule which has a socket opening 60 for receiving an end portion of a corresponding rafter 32.

Figure 6B:
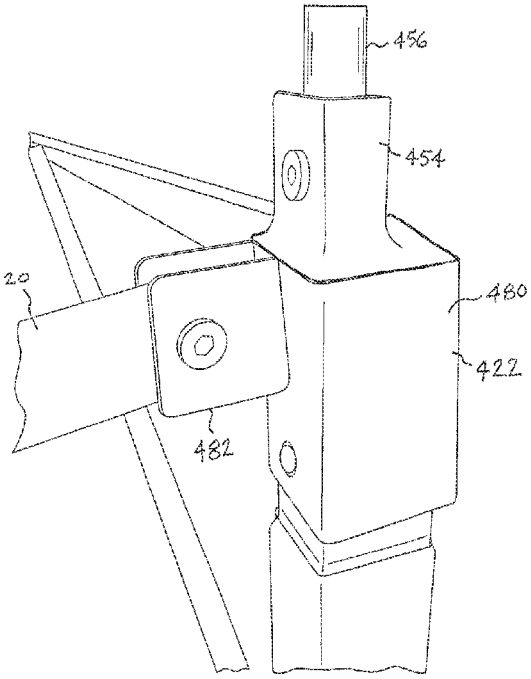
FIG. 6B is an enlarged perspective view of a mount with an integral socket.

An alternative construction of a mount 422 is shown in FIG. 6B. Mount 422 includes a clevis bracket 454 disposed directly on central portion 480. Clevis 454 rotatably supports a socket 456 for receiving an end portion of a corresponding rafter 32. Mount 422 also includes clevis portions 482 for connecting to scissor units 20. Accordingly, mount 422 combines the mount 22 and rafter fitting 30, described above, into an integrated component.

Returning to FIG. 3, roof frame 14 includes rafters 32 disposed on the ends of the framework with a cross member rafter 33 located between the two end rafters 32. Each rafter 32 and 33 is, in this case, comprised of a pair of rafter segments 36 which are connected together by a splice lifting 40. A ridge member 34 is configured to extend between the distal ends of the rafters 32. In this case, the ridge member 34 comprises multiple ridge segments 38 which are connected together by splice fittings 40. Where the ridge member intersects the cross member rafters 33, a cross fitting 44 joins the various segments in a cross pattern. With reference to FIG. 5, it can be appreciated that socket 56 is sized and configured to receive an end portion of an associated rafter segment 36. In this embodiment, each rafter 32, 33 extends arcuately between opposed cross members 18. It can also be appreciated in the figures that the rafters 32, 33 are parallel to each other. In this case, each rafter segment is comprised of flexible rod, such as fiberglass, composite, or aluminum rod, all as known in the art. The rafters may also include stretchable shock chord threaded through and between the rafter segments, also as known in the art.

Figure 10:
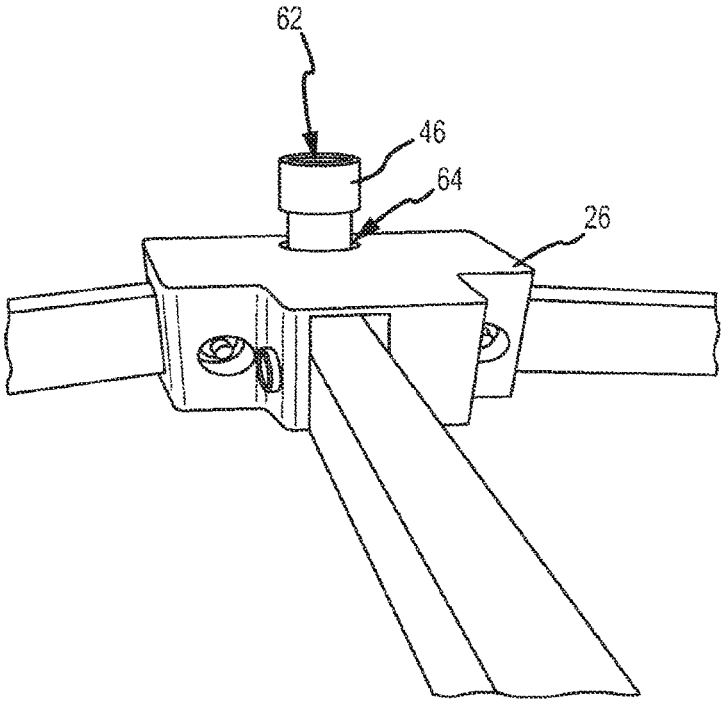
FIG. 10 is an enlarged perspective view of the upper cross member mount and rafter insert.

Referring again to FIG. 3, the cross member rafters 33 extend from the upper cross member mounts 26. With further reference to FIG. 10, the upper cross member mount 26 includes an insert opening 64 sized and configured to receive a cross member rafter insert 46. Cross member rafter insert 46 includes a receptacle 62 which is configured to receive an end portion of rafter segment 36 of cross member rafter 33.

Figure 11:
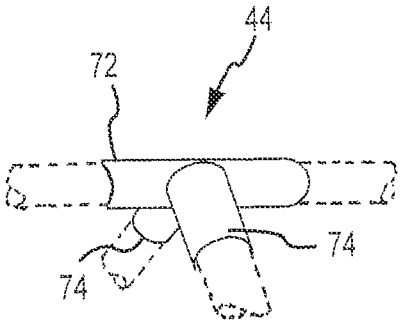
FIG. 11 is an enlarged perspective view of the cross fitting shown in FIG. 3.
Figure 14:
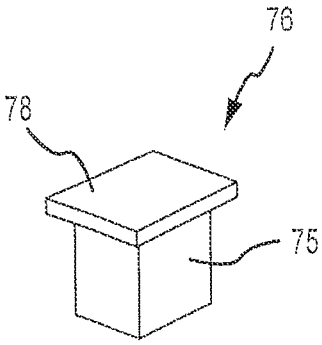
FIG. 14 is an enlarged perspective view of a mount opening plug as shown in FIG. 4.
Figure 12:
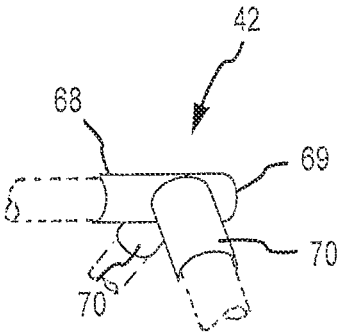
FIG. 12 is an enlarged perspective view of a ridge fitting as shown in FIG. 3.
Figure 13:
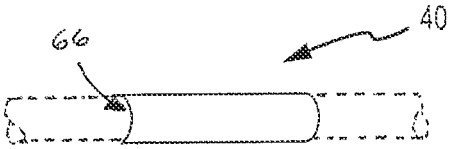
FIG. 13 is an enlarged perspective view of the splice fitting shown in FIG. 3.
Figure 15:
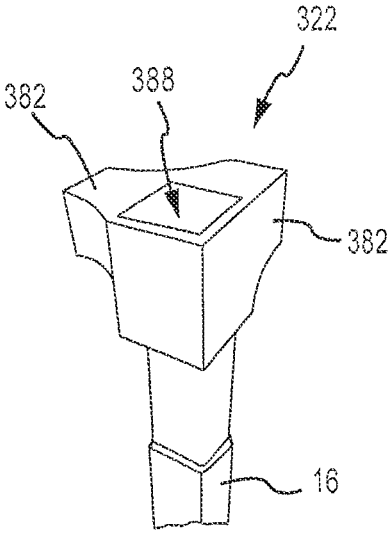
FIG. 15 is an enlarged perspective view of a mount according to an alternative exemplary embodiment.

Referring to FIG. 11, cross fitting 44 includes a hollow tube 72 configured to receive a pair of ridge segments 38. Extending from hollow tube 72 is a pair of branches 74 configured to receive end portions of rafter segments 36 of the cross member rafter 33. As shown in FIG. 12, the ridge fitting 42 includes a hollow tube 68 that is closed on one end 69. Extending from the hollow tube 68 adjacent closed end 69 is a pair of branches 70 for receiving end portions of rafters 32. FIG. 3 illustrates splice fitting 40 as a hollow tube 66. FIG. 14 shows the mount opening plug 76 which comprises a male portion 75 and a plug cap 78 configured as shown. FIG. 15 illustrates an alternative construction for a mount 322 which includes a central portion 386 and a pair of clevis portions 382. In this embodiment, the central portion 386 and clevis portions 382 are integrally formed as a unitary body. For example, mount 322 may be injection molded. Mount 322 also includes a mount opening 388 for connecting a rafter thereto.

Figure 16:
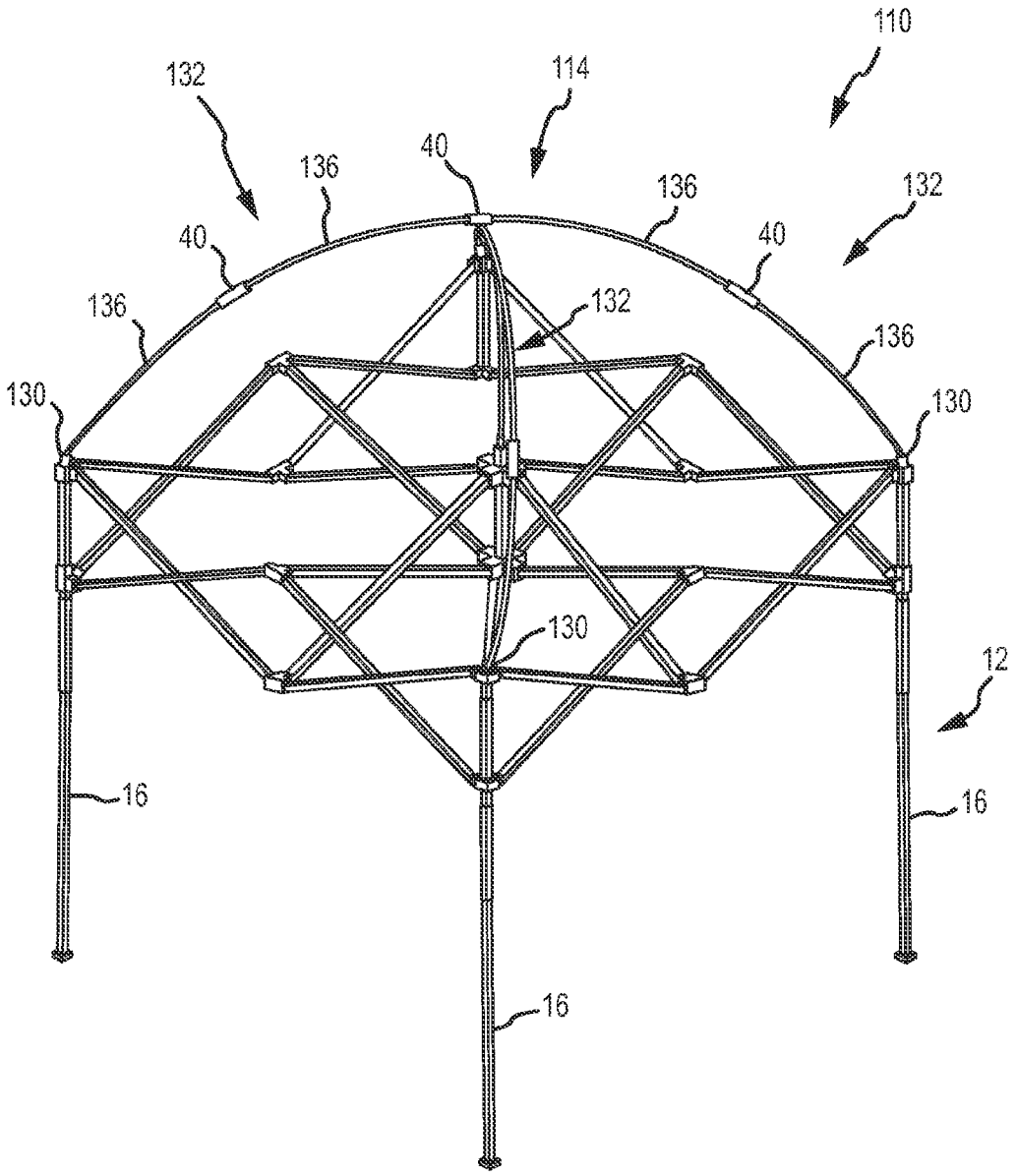
FIG. 16 is a perspective view of the canopy framework as shown in FIG. 2.

FIG. 16 illustrates the construction of the dome framework 110 for use with a canopy 105 shown in FIG. 2. Dome framework 110 includes base frame 12 as described above but with a different roof frame construction 114. Roof frame 114 comprises rafter fittings 130 from which extend a plurality of rafters 132. Each rafter 132 is comprised of rafter segments 136 joined by splice fittings 40. The rafters extend arcuately from rafter fittings 130, and the rafters extend diagonally between opposite upright support members 16. Accordingly, in this embodiment the rafters cross cadi other in contrast to the parallel rafters described above with respect to the first exemplary embodiment.

Figure 8:
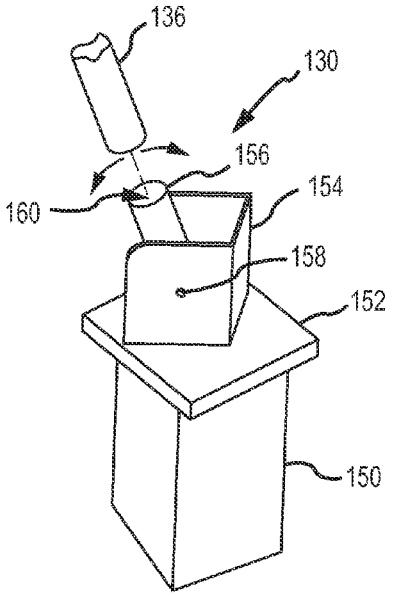
FIG. 8 is a rafter fitting according to an alternative construction for use with the domed canopy as shown in FIG. 2.
Figure 17:
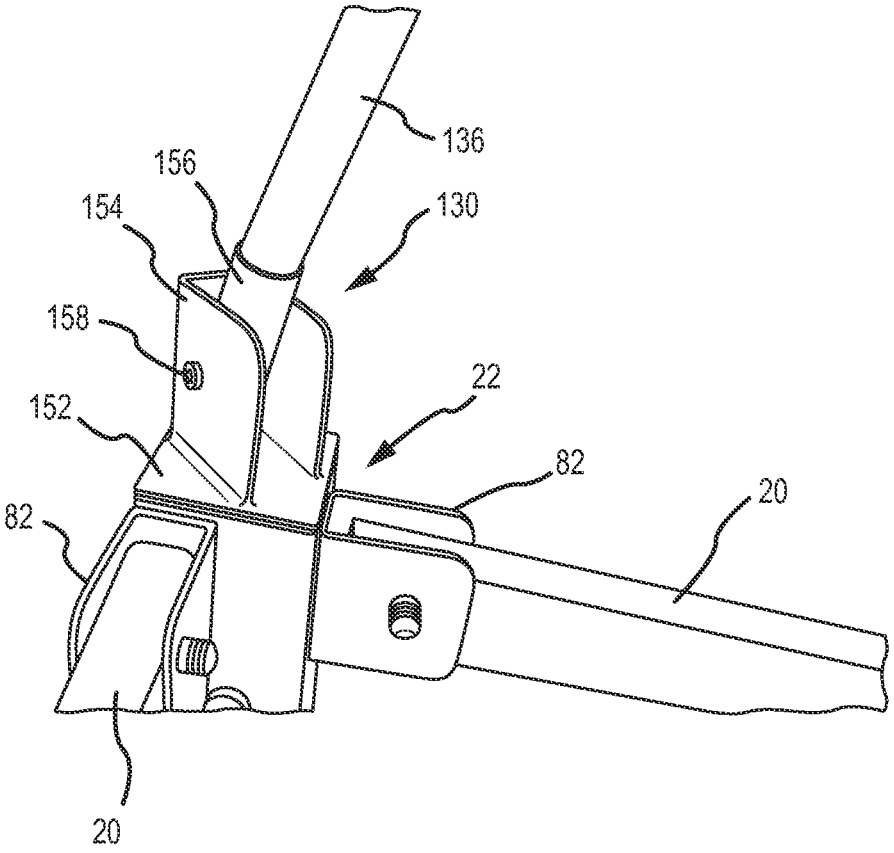
FIG. 17 is an enlarged perspective view of the rafter fitting as shown in FIG. 16.

With reference to FIGS. 8 and 17, the rafter fitting 130 used with the dome canopy 105 has a similar construction to the rafter fitting 30 described above with the first exemplary embodiment. However, in this case, clevis 154 is mounted at an angle—with respect to cap 152 and male portion 150. The angle of clevis 154 is approximately 45 degrees with respect to the male portion 150. Accordingly, because the male portion 150 is rectangular or square in shape, the ferrule 156 is directed at a diagonal angle with respect to each upright support member 16. Rafter fitting 130 also includes a socket 156 that is pivotably disposed on clevis 154 by a clevis pin 158. Socket 156 may be in the form of a ferrule as shown with a socket opening 160 for receiving a rafter segment 136.

Figure 9:
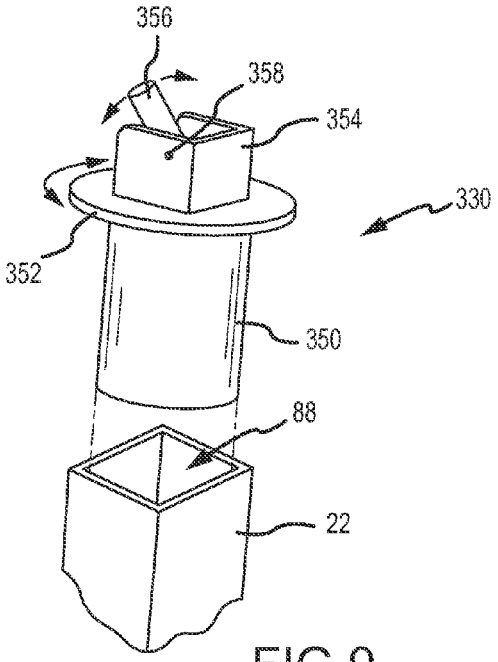
FIG. 9 is yet another alternative construction of a rafter fitting.

An alternative construction of a rafter fitting 330 is shown in FIG. 9. Rafter fitting 330 is similar in construction to that described above with respect to FIGS. 7 and 8; however, the male portion 350 is, in this case, in the form of a cylinder rather than a square. Accordingly, male portion 350 may rotate within the mount opening 88 of mount 22. Therefore, rafter fitting 330 may be used for both the rounded gable roof frame and the dome roof frame. In the case of the dome roof frame, the cylindrical male portion 350 allows the rafter fitting to orient such that the rafters 132 extend diagonally opposite upright support members 16. Rafter fitting 330 includes male portion 350 with a cap 352 disposed thereon. Clevis 354 is mounted to cap 352 and rotatably supports a socket 356 which rotates about clevis pin 358.

Figure 18:
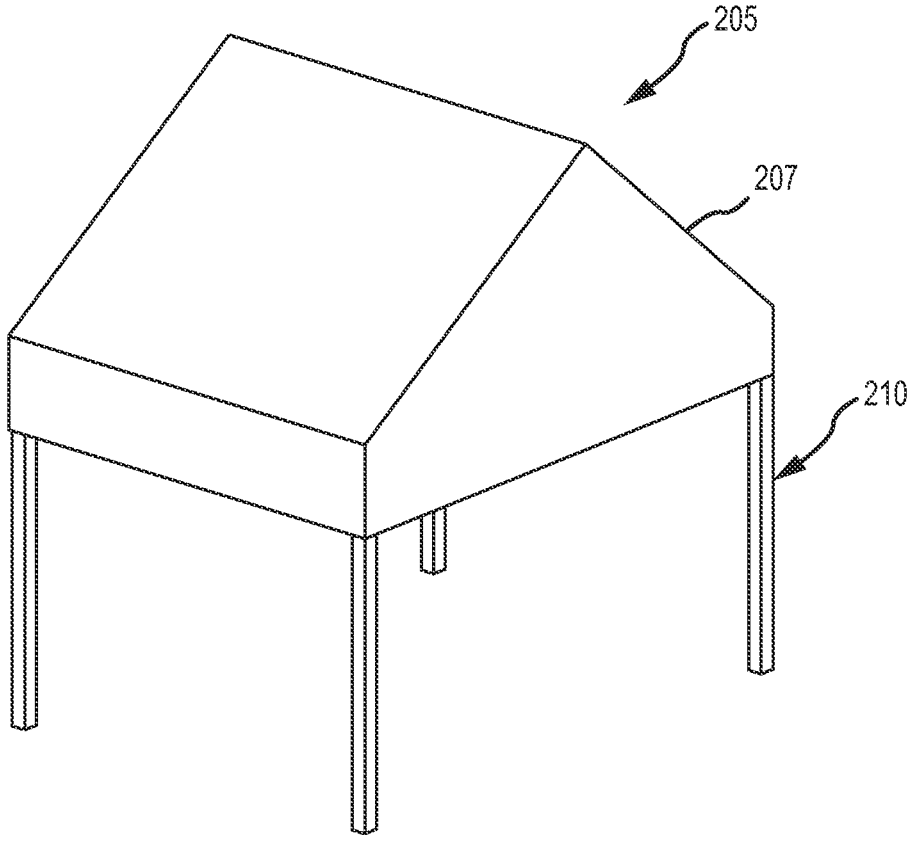
FIG. 18 is a perspective view of a canopy with a peaked gable roof.
Figure 19:
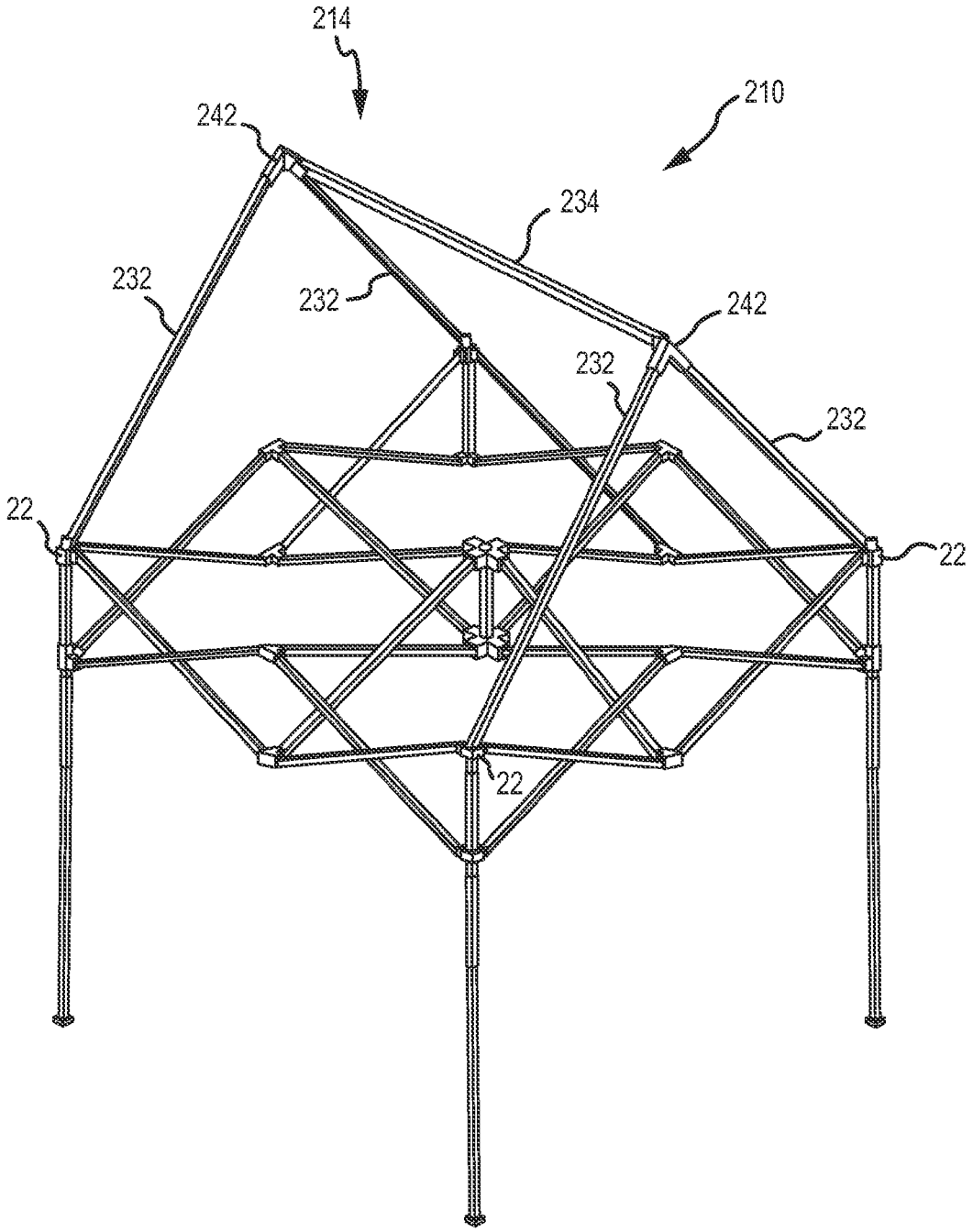
FIG. 19 is a perspective view of the framework shown in FIG. 18.
Figure 20:
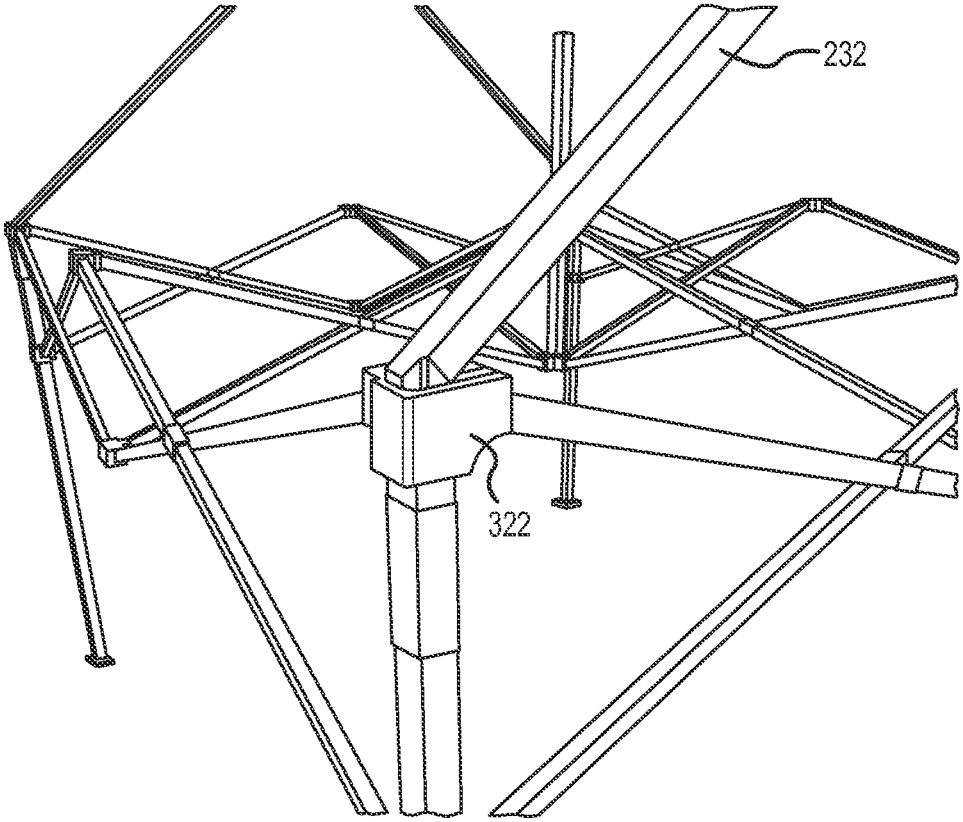
FIG. 20 is an enlarged perspective view of the rafter and mount as shown in FIG. 19.
Figure 21:
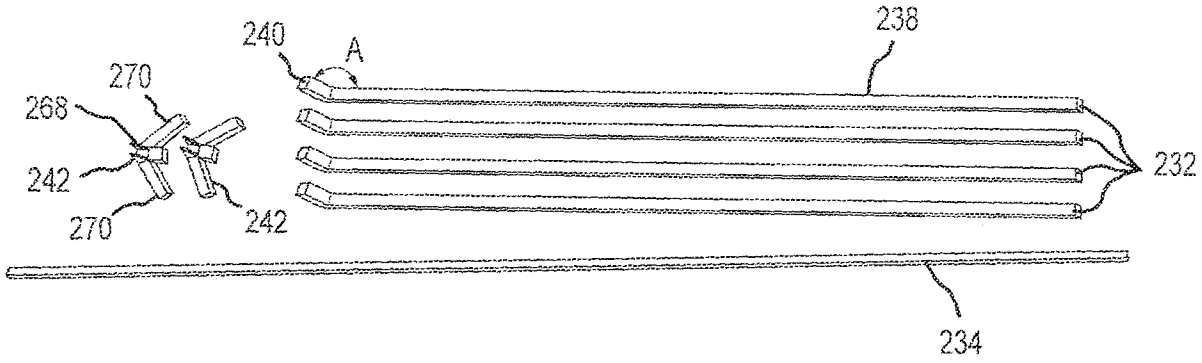
FIG. 21 is a perspective view of the components of the roof frame shown in FIG. 19.

A third exemplary embodiment of a canopy 205 is shown in FIG. 18. In this embodiment, the roof is in the form of a peaked gable. Canopy 205 includes a framework 210 with a canopy cover 207. As shown in FIG. 19, the framework 210 includes base frame 12 as described above and a roof framework 214. Roof frame 214 includes a plurality of rafters 232 extending from mounts 22 which are operative to support the canopy cover 207 above base frame 12. Roof frame 214 also includes a ridge member 234 extending between the rafters 232. A ridge fitting 242 connects the ridge member to rafters 232 as shown. With reference to FIG. 20, in this embodiment, the base frame includes the unitary mount 322 as described with respect to FIG. 15. With further reference to FIG. 21, it can be appreciated that the roof frame 210 may be disassembled into components. Each rafter 232 includes an arm portion 238 with a stub portion 240 extending therefrom at an angle A. Angle A may be approximately 45 degrees. However, the angle at which stub portion 240 extends from arm portion 238 may vary to provide different roof configurations. Each ridge fitting 242 includes a ridge clevis 268 for attachment to the ridge member 234. Extending at angles from the ridge clevis 268 is a pair of branches 270. In this embodiment, it is contemplated that the rafters and ridge members are comprised of tubing, such as steel or aluminum tubing having a square cross-section, for example. However, tubing or bar of other materials and cross sections may be used. It should also be understood that the rafters may be a single piece of bent tubing that forms the arm portion 238 and stub portion 240. Alternatively, the arm portion and stub portion may be welded or otherwise fastened together.

Figure 23:
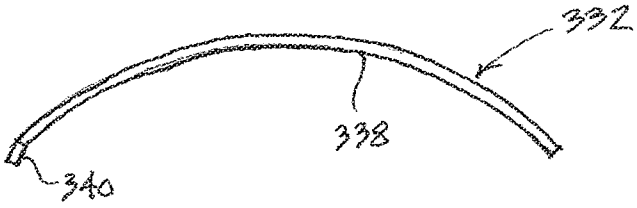
FIG. 23 is a perspective view of a representative rafter for a roof frame.
Figure 22:
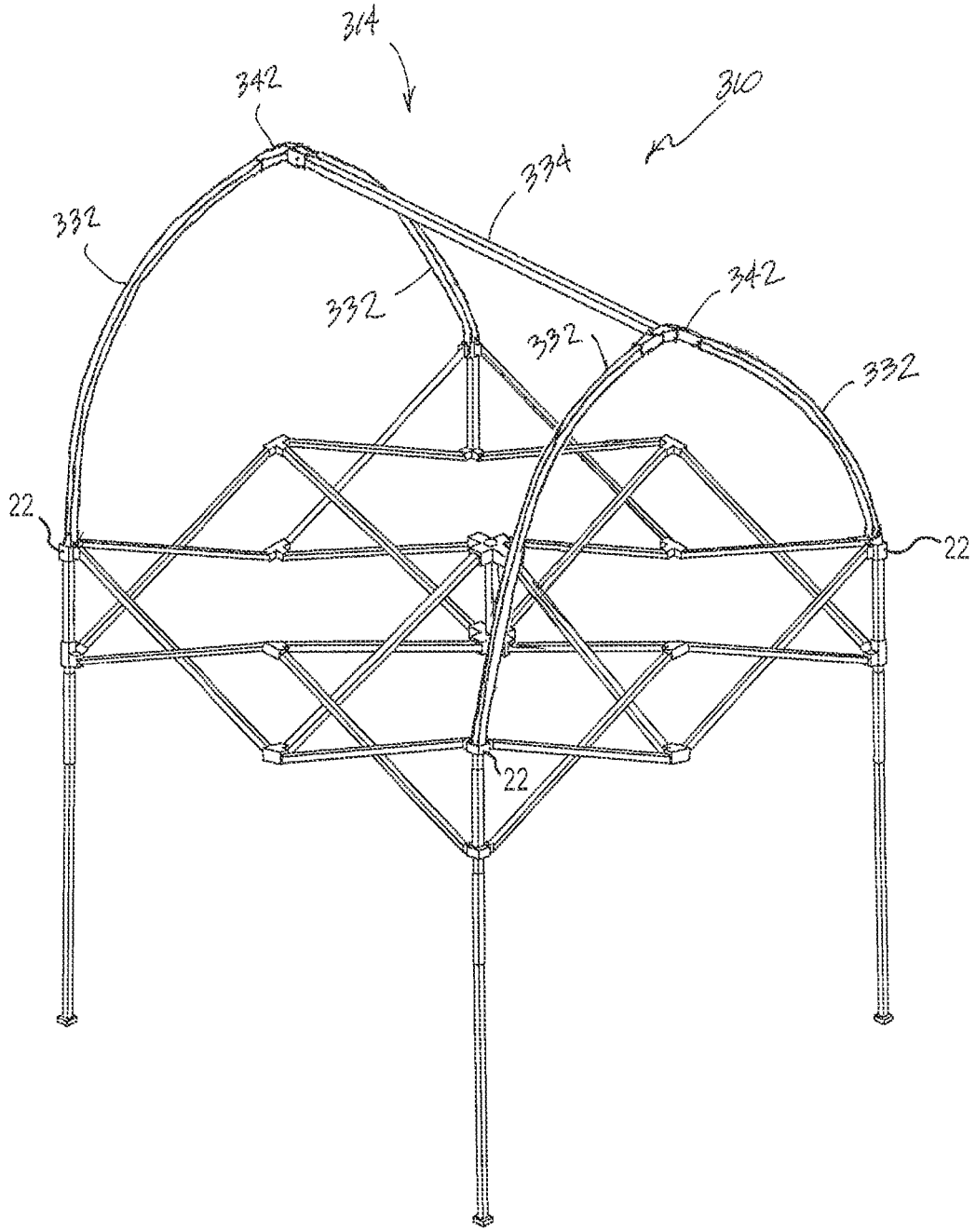
FIG. 22 is a perspective view of an alternate embodiment of a framework.

A fourth exemplary embodiment of a framework 310 is shown in FIG. 22. In this embodiment, framework 310 may be used to create a rounded gable roof configuration, such as that shown in FIG. 1. However, in this embodiment, it is contemplated that the rafters and ridge members are comprised of tubing, such as steel or aluminum tubing having a square cross-section, for example. As shown in FIG. 22, the framework 310 includes base frame 12 as described above and a roof framework 314. Roof frame 314 includes a plurality of rafters 332 extending arcuately from mounts 22 which are operative to support a canopy cover, such as canopy cover 207, shown in FIG. 1. Roof frame 314 also includes a ridge member 334 extending between the rafters 332. A ridge fitting 342 connects the ridge member to rafters 332 as shown. With further reference to FIG. 23, it can be appreciated that the roof frame 310 may be disassembled into components. Each rafter 332 includes an arcuate arm portion 338 and a stub portion 340. Ridge fittings 342 have a similar construction to that shown in FIG. 21, albeit the angles between branches may vary to accommodates the arcuate arm portions 338 of the arcuate rafters 332.

Also contemplated herein is a method of erecting a canopy. In one embodiment, the method comprises expanding a base frame 12 that includes a plurality of upright support members 16 and a plurality of mounts 22 disposed on the upright support members 16, mounting a roof frame 14 to the base frame 12, and subsequently removing the roof frame 14 from the base frame 12. The step of mounting the roof frame 14 to the base frame 12 includes connecting rafter fittings 30 to the mounts 22. The mounts 22 include mount openings 88 and the rafter fittings 30 are inserted into the mount openings 88. The method may also include connecting rafters 32 to the rafter fittings 30 and connecting a ridge member 34 to the rafters 32.

The above described exemplary embodiments of the framework with a removably mountable roof frame provide for a more easily transportable canopy. The base frame and roof frame assembles may now be transported separately, each accounting for a portion of the overall weight of the structure. The disclosed framework also provides more versatility over traditional canopy structures because different roof constructs can be used with a given frame. Accordingly, the overall cost of having multiple roof configurations is reduced because multiple interchangeable removably mountable roof frames may be used with a single base framework.

Accordingly, the removably mountable roof frame has been described with some degree of particularity directed to the exemplary embodiments. It should be appreciated; however, that the present invention is defined by the following claims construed in light of the prior art so that modifications or changes may be made to the exemplary embodiments without departing from the inventive concepts contained herein.

What is claimed is:

1. An erectable canopy framework, comprising:

a base frame, including:

a plurality of upright support members;

a plurality of expansion and contraction assemblies, each interconnecting adjacent upright support members to permit the base frame to move between an expanded and a contracted state; and a plurality of mounts disposed on the upright support members operative to fasten the expansion and contraction assemblies thereto, wherein each mount includes a mount opening; and a roof frame removably mountable to the base frame, the roof frame including:

a plurality of rafter fittings each comprising a male portion insertable into a corresponding mount opening and a socket pivotably attached to the male portion;

a plurality of rafters each insertable into a corresponding socket;

a ridge member configured to extend between distal ends of the rafter portions; and a pair of ridge fittings each operative to interconnect a pair of the rafters with opposite ends of the ridge member.

2. The erectable canopy framework according to claim 1, wherein each rafter comprises at least one flexible rod.

3. The erectable canopy framework according to claim 2, wherein each rafter comprises multiple rafter segments.

4. The erectable canopy framework according to claim 1, wherein each socket is in the form of a ferrule.

5. The erectable canopy framework according to claim 1, wherein each ridge fitting comprises a plurality of ridge sockets.

6. The erectable canopy framework according to claim 1, wherein the ridge member comprises multiple ridge segments.

7. The erectable canopy framework according to claim 1, wherein each rafter extends arcuately from a corresponding socket.

8. The erectable canopy framework according to claim 1, further comprising a pair of cross member rafters extending arcuately between opposed expansion and contraction assemblies.

9. The erectable canopy framework according to claim 8, wherein each expansion and contraction assemblies includes a pair of scissor units connected together by upper and lower cross member mounts, and wherein the upper cross member mount includes an insert opening adapted to receive a cross member rafter insert connectable with the cross member rafters.

10. An erectable canopy framework, comprising:

a base frame, including:

a plurality of upright support members;

a plurality of expansion and contraction assemblies, each interconnecting adjacent upright support members to permit movement of the base frame between an expanded and a contracted state; and a plurality of mounts disposed on the upright support members operative to fasten the expansion and contraction assemblies thereto, wherein each mount includes a mount opening; and a roof frame removably mountable to the base frame, the roof frame including:

a plurality of rafter fittings each comprising a male portion insertable into a corresponding mount opening and a socket pivotably attached to the male portion;

a plurality of rafters each insertable into a corresponding socket, wherein each rafter extends arcuately and diagonally between opposite upright support members.

11. The erectable canopy framework according to claim 10, wherein each rafter comprises at least one flexible rod.

12. The erectable canopy framework according to claim 11, wherein each rafter comprises multiple rafter segments.

13. The erectable canopy framework according to claim 10, wherein each socket is in the form of a ferrule.

* * * * *